US011298840B2

(12) United States Patent
Koike

(10) Patent No.: US 11,298,840 B2
(45) Date of Patent: Apr. 12, 2022

(54) ROTARY ELECTRIC SHAVER

(71) Applicant: Izumi Products Company, Matsumoto (JP)

(72) Inventor: Hideaki Koike, Matsumoto (JP)

(73) Assignee: Maxell Izumi Co., Ltd., Matsumoto (JP)

( * ) Notice: Subject to any disclaimer, the term of this patent is extended or adjusted under 35 U.S.C. 154(b) by 0 days.

(21) Appl. No.: 16/199,769

(22) Filed: Nov. 26, 2018

(65) Prior Publication Data

US 2019/0176353 A1 Jun. 13, 2019

(30) Foreign Application Priority Data

Dec. 8, 2017 (JP) ..... JP2017-236124

(51) Int. Cl.
*B26B 19/14* (2006.01)
*B26B 19/28* (2006.01)
*B26B 19/36* (2006.01)

(52) U.S. Cl.
CPC ..... *B26B 19/145* (2013.01); *B26B 19/14* (2013.01); *B26B 19/28* (2013.01); *B26B 19/36* (2013.01)

(58) Field of Classification Search
CPC ..... B26B 19/14; B26B 19/145; B26B 19/28; B26B 19/36
USPC ..... 30/42, 43.4, 43.5, 43.6
See application file for complete search history.

(56) References Cited

U.S. PATENT DOCUMENTS 2,096,379 A * 10/1937 Peak ..... B26B 19/18 30/43.6
2,659,139 A * 11/1953 Davison ..... B26B 19/14 30/41.5
2,903,789 A * 9/1959 Schleifer ..... B26B 19/28 30/43.9
4,827,613 A * 5/1989 Bakker ..... B26B 19/16 30/346.51
4,884,338 A * 12/1989 Stewart ..... B26B 19/141 30/43.92
4,894,912 A * 1/1990 Tietjens ..... B26B 19/16 30/43.3

(Continued)

FOREIGN PATENT DOCUMENTS

DE 94 19 805 U1 * 6/1996 ..... B26B 19/28
JP S62-4282 U 1/1987

(Continued)

*Primary Examiner* — Clark F Dexter
(74) *Attorney, Agent, or Firm* — Muncy, Geissler, Olds & Lowe, P.C.

(57) ABSTRACT

A rotary electric shaver includes a main body in which a first transmission mechanism, and a connecting portion is disposed; a head unit in which a plurality of blade units each having an outer blade, an inner blade being in sliding contact with an inner surface of the outer blade, and a driven shaft rotating the inner blade are disposed, and a second transmission mechanism that transmits a driving power of the first transmission mechanism to rotate the driven shaft is built, and which is connected to the connecting portion; and a drive shaft for transmitting the driving power of the first transmission mechanism to the second transmission mechanism, wherein a first endless belt is disposed in the first transmission mechanism and a second endless belt is disposed in the second transmission mechanism.

4 Claims, 5 Drawing Sheets

(56) References Cited

U.S. PATENT DOCUMENTS

| | | | | |
|---|---|---|---|---|
| 5,313,704 | A * | 5/1994 | Atsumi et al. | B26B 19/28 30/43.6 |
| 6,979,936 | B1 * | 12/2005 | Ganor et al. | B26B 19/28 310/323.01 |
| 7,647,699 | B1 * | 1/2010 | Geile | B26B 19/14 30/133 |
| 8,127,453 | B2 * | 3/2012 | Haczek et al. | A45D 26/0023 30/43.92 |
| 8,458,910 | B2 * | 6/2013 | Haczek et al. | A45D 26/0023 30/43.92 |
| 9,352,476 | B1 * | 5/2016 | Holmes | B26B 19/205 |
| 2006/0048390 | A1 * | 3/2006 | Baron et al. | B26B 19/14 30/43.6 |
| 2007/0084059 | A1 * | 4/2007 | Hannan et al. | B26B 19/14 30/43.5 |
| 2007/0234572 | A1 * | 10/2007 | Hannan et al. | B26B 19/14 30/43.92 |
| 2010/0011589 | A1 * | 1/2010 | Van Der Borst et al. | B26B 19/14 30/43.4 |
| 2017/0368700 | A1 * | 12/2017 | Fischer et al. | B26B 19/282 |

FOREIGN PATENT DOCUMENTS

| | | | | |
|---|---|---|---|---|
| JP | 2006-514870 A | | 5/2006 | |
| WO | WO 03/059584 | * | 7/2003 | B26B 19/141 |

* cited by examiner

ROTARY ELECTRIC SHAVER

CROSS-REFERENCE TO RELATED APPLICATION

This application is based upon and claims the benefit of priority of the prior Japanese Patent Application No. P2017-236124, filed on Dec. 8, 2017, the entire contents of which are incorporated herein by reference.

TECHNICAL FIELD

The present invention relates to a rotary electric shaver.

BACKGROUND ART

A rotary electric shaver includes a main body in which a motor is built, a head unit having a plurality of blade units each having an outer blade which has a circular shaving surface on an outer side, and an inner blade which is in sliding contact with an inner surface of the outer blade, so as to provide a structure in which the head unit is connected to a connecting portion disposed in the main body, and includes a driving power transmission mechanism transmitting a driving power from the motor to rotate the inner blade.

In the related art, as the driving power transmission mechanism in the rotary electric shaver having a single blade unit, there is known a configuration using a belt driving system or a configuration using a gear driving system (PTL 1: JP-UM-A-62-4282). In addition, as the driving power transmission mechanism having plural blade units, there is known a configuration of a gear driving system (PTL 2: JP-T-2006-514870).

SUMMARY OF INVENTION

Technical Problem

In recent years, a rotary electric shaver in which a plurality of blade units are disposed becomes wide spread due to high shaving ability and good contact efficiency to the skin. As the number of blade units is increased, the number of gears for rotating the inner blade corresponding to the outer blade is inevitably increased. Therefore, gear noise caused by meshing of the gears becomes large and a user feels that the noise is offensive to the ear. In addition, it is a cause of product noise. In the present specification, in the gear driving system, gear noise including a sound generated by meshing gears is defined as a "gear sound" and is distinguished from an operation sound of the motor. A belt driving system illustrated in PLT 1 can perform noise-reduction because the "gear sound" generated by meshing gears as in the gear driving system is not caused. In addition, in a case of a single blade unit as in PTL 1, an endless belt is wound around two pulleys, and therefore, it is relatively easy to employ the belt driving system.

On the other hand, in a case of a plurality of blade units as in PTL 2, a plurality of inner blades have to be rotated by winding the endless belt on three or more pulleys and the belt driving system is difficult to be employed. In addition, if the endless belt is wound around three or more pulleys, a tension may not be uniformly applied, and in general, it is considered that a belt tension adjustment mechanism is required. However, if the belt tension adjustment mechanism is disposed, a size of the head unit or the main body increases, a component cost or a manufacturing cost increases, and a size thereof increases, so that there are problems such as poor usability and poor appearance.

Solution to Problem

The present invention is made in view of the above circumstances and an object of the invention is to provide a rotary electric shaver having a noise-reduction structure by a belt driving system is enhanced.

The present invention has been accomplished under the solutions as disclosed below.

A rotary electric shaver according to the present invention includes: a main body in which a motor and a first transmission mechanism that transmits a driving power of the motor are built, and a connecting portion is disposed; a head unit in which a plurality of blade units each having an outer blade having a circular shaving surface on an outer side, an inner blade being in sliding contact with an inner surface of the outer blade, and a driven shaft rotating the inner blade, and a second transmission mechanism that transmits a driving power of the first transmission mechanism to rotate the driven shaft is built, and which is connected to the connecting portion; and a drive shaft that transmits the driving power of the first transmission mechanism to the second transmission mechanism, wherein a first endless belt is disposed in the first transmission mechanism, and a second endless belt is disposed in the second transmission mechanism. In this invention, examples of hairs to be shaved include beards, mustaches, whiskers, and the like.

According to the configuration, since each of the first transmission mechanism and the second transmission mechanism is driven by a belt, it is possible to apply tension evenly for each belt by each of the transmission mechanisms, therefore eliminating the need for tension adjustment, so that it is possible to maintain a current size. The "gear sound" can be eliminated by using the belt driving system, so that noise-reduction is performed.

Advantageous Effects of Invention

According to the invention, with respect to a rotary electric shaver in which a plurality of blade units are disposed, there can be realized a rotary electric shaver having a new structure, which eliminates the "gear sound" to thereby achieve noise-reduction while maintaining a current size.

DESCRIPTION OF EMBODIMENTS

Figure 1:
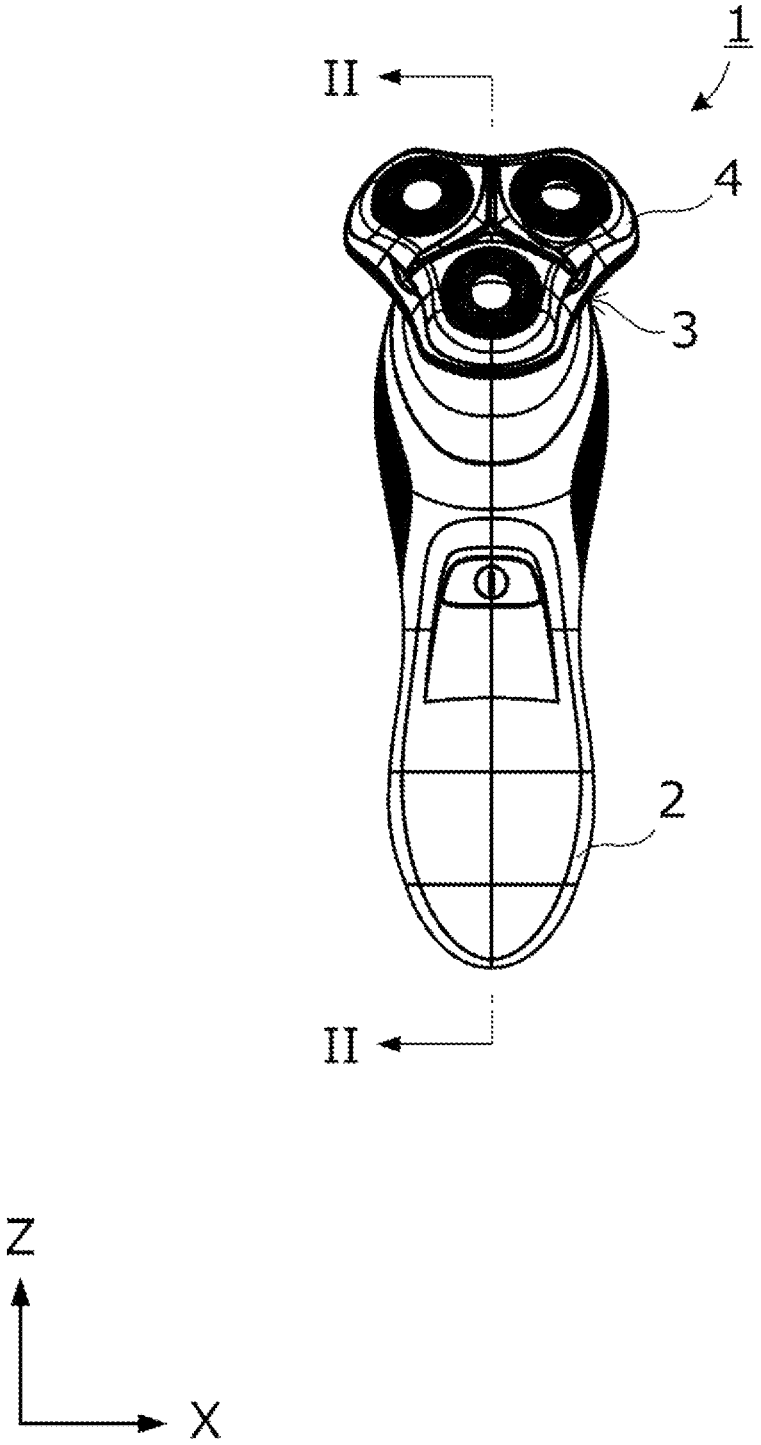
FIG. 1 is a front view schematically illustrating an example of a rotary electric shaver according to an embodiment of the invention.

Hereinafter, an embodiment of the invention will be described in detail with reference to the drawings. The embodiment is, for example, a rotary electric shaver 1 in which a plurality of blade units are disposed. Hereinafter, it may be simply referred to as the "electric shaver". Moreover, in all drawings for explaining the embodiment, the same reference numerals are given to members having the same function and repetitive description thereof may be omitted in some cases.

As illustrated in FIGS. 1 to 5, the electric shaver 1 includes, for example, a main body 2 gripped by a user and a head unit 4 connected to a connecting portion 3 which is disposed between the head unit 4 and the main body. Here, in order to make it easy to explain a positional relationship of each portion of the electric shaver 1, directions are indicated by arrows X, Y, and Z in the drawings.

A front side of the main body 2 is an operation panel and a selection button for selecting an operation is provided. A motor 7, a power supply unit 91 that supplies electricity to the motor 7, and a control unit 92 that controls the motor 7 and the power supply unit 91 are built in the main body 2.

The head unit 4 is provided with a plurality of blade units 8 each having a cap-shaped outer blade 81 having a circular shaving surface on an outer side, an inner blade 82 being in sliding contact with an inner surface of the outer blade 81, and a driven shaft 85 rotating the inner blade 82. In the embodiment, three blade units 8 are disposed at equal intervals in a circumferential direction with respect to a center of the head unit 4 in a plan view. In addition, the head unit 4 includes an outer blade frame 41 that holds the blade unit 8 such that the blade unit 8 is capable of swing movement, and a blade setting base 42 through which the driven shaft 85 passes and which holds the outer blade frame 41.

Figure 2:
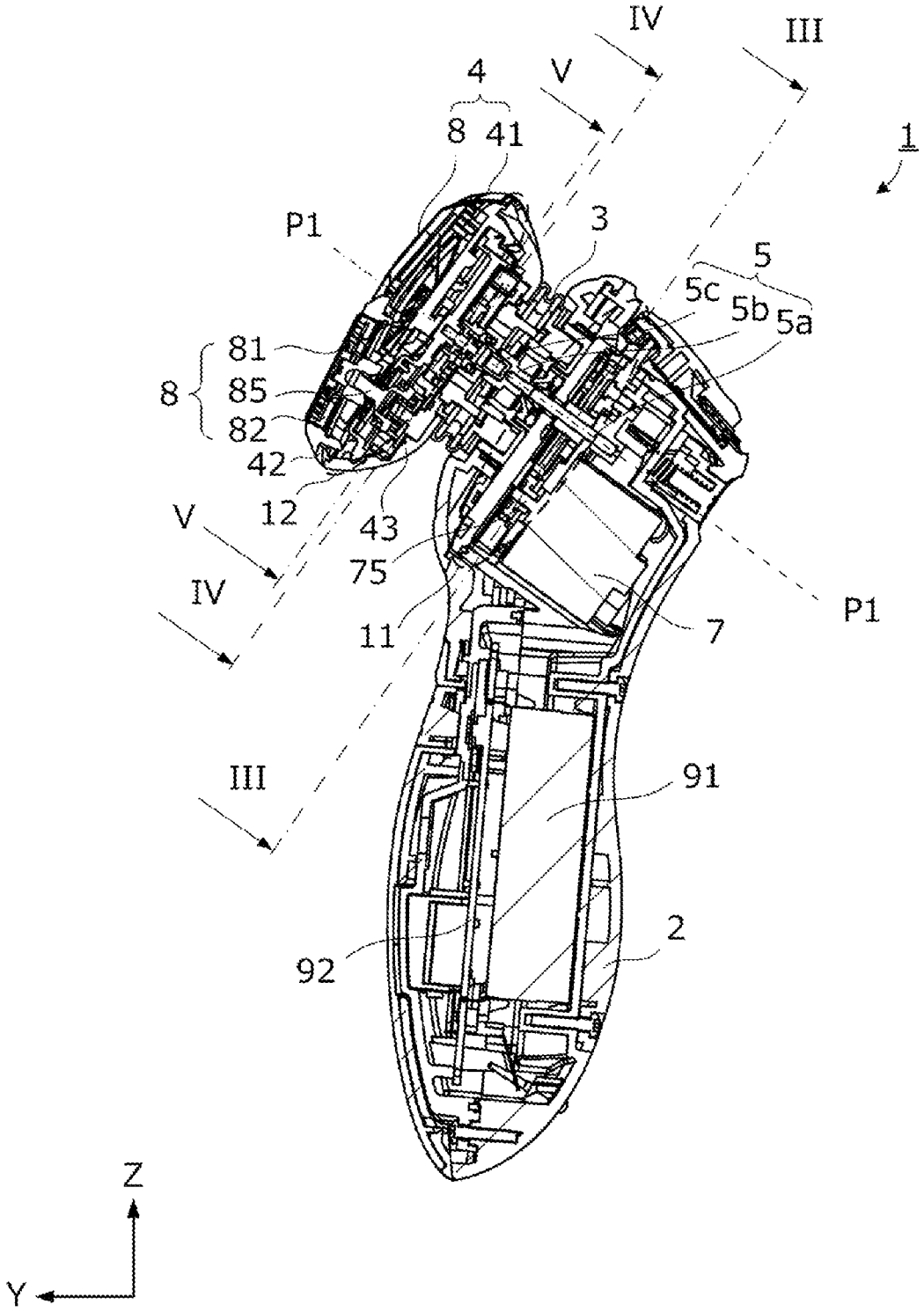
FIG. 2 is a sectional view that is taken along line II-II in FIG. 1 in which an internal structure is omitted.

As illustrated in FIG. 2, a first transmission mechanism 11 of a belt driving system for transmitting a driving power of the motor 7 is built in the main body 2. A second transmission mechanism 12 of a belt driving system for transmitting a driving power of the first transmission mechanism 11 via a drive shaft 5 to rotate the driven shaft 85 is built in the head unit 4. The head unit 4 includes a blade setting base support plate 43 through which the drive shaft 5 passes and which supports the blade setting base 42. In FIG. 2, the first transmission mechanism 11 and the second transmission mechanism 12 are indicated respectively by areas surrounded by broken lines.

In the example illustrated in FIG. 2, the drive shaft 5 is configured of a shaft portion 5*a* on a side of the main body 2, a shaft portion 5*c* on 4 a side of the head unit 4, and a coupling portion 5*b* which is built in the connecting portion 3 and couples the shaft portion 5*a* and the shaft portion 5*c* such that the shaft portion 5*a* and the shaft portion 5*c* are capable of swing movement in X, Y, and Z directions.

Figure 3:
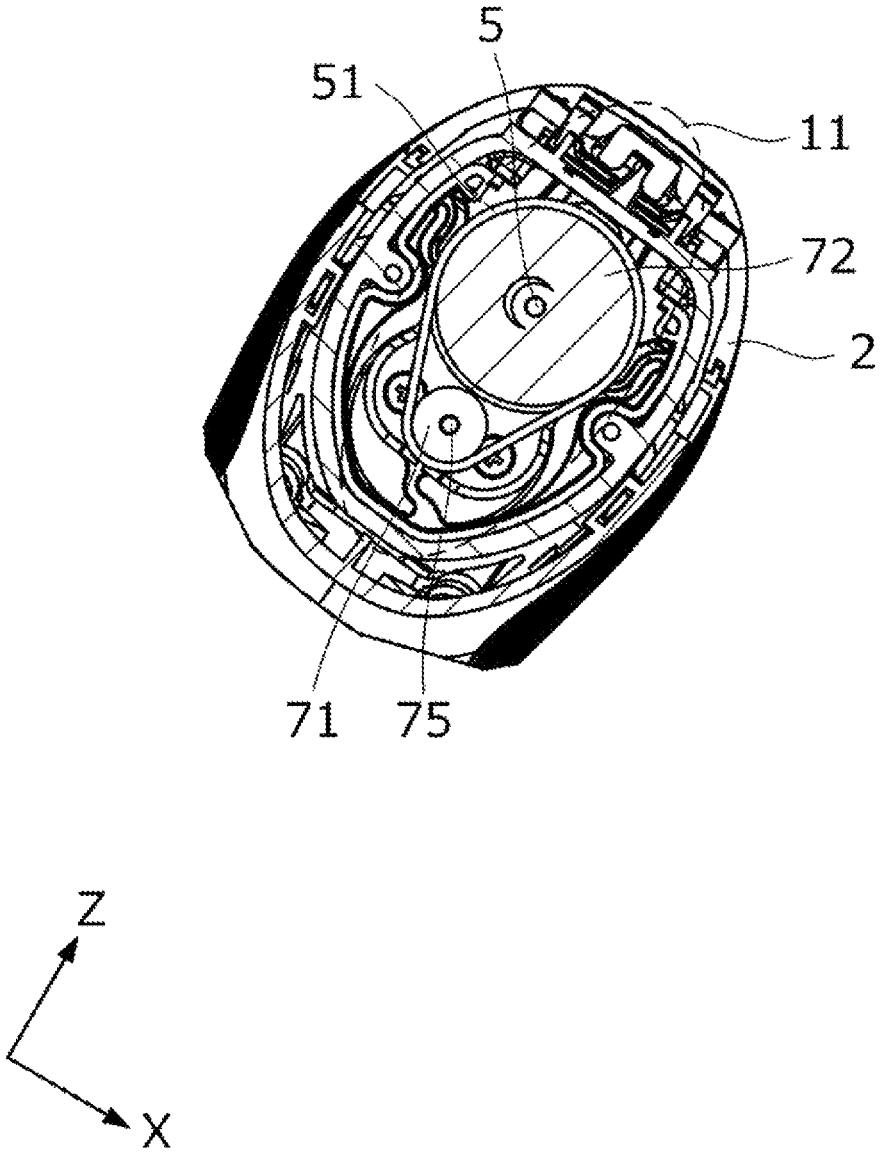
FIG. 3 is a sectional view that is taken along line in FIG. 2 in which an internal structure is omitted and is a schematic view illustrating an example of a first transmission mechanism.

As illustrated in FIG. 3, the first transmission mechanism 11 of the belt driving system for transmitting the driving power of the motor 7 is built in the main body 2. The first transmission mechanism 11 is configured such that a first pulley 71 is connected to an output shaft 75 of the motor 7 and a second pulley 72 is connected to the drive shaft 5 on a side of the main body 2. The first endless belt 51 is wound around the first pulley 71 and the second pulley 72.

According to the configuration, since the first endless belt 51 is wound around two pulleys including the first pulley 71 and the second pulley 72, it is possible to apply tension evenly for the belt, therefore eliminating the need for tension adjustment by providing a tensioner, so that it is possible to maintain a current size. The "gear sound" can be eliminated by using the belt driving system, so that noise-reduction is performed.

For example, the first endless belt 51 is a one-side toothed belt, and the first pulley 71 and the second pulley 72 are toothed pulleys. Therefore, slip is prevented. Moreover, it is not limited to the example and the first endless belt 51 may be a flat belt or a V-belt, and the first pulley 71 and the second pulley 72 corresponding to the shape of the first endless belt 51 may be used.

For example, a diameter of the second pulley 72 is set to be 1.5 times or more and less than 5 times a diameter of the first pulley 71. Preferably, a diameter of the second pulley 72 is set to be 2 times or more and less than 4 times a diameter of the first pulley 71. More preferably, a diameter of the second pulley 72 is set to be 2.5 times or more and less than 3.5 times a diameter of the first pulley 71. Particularly, a diameter of the second pulley 72 is set to be substantially 3 times a diameter of the first pulley 71. As a result, a driving torque from the motor 7 is increased to substantially 3 times and a driving torque for rotating three inner blades 82 is ensured by the main body 2, so that it is possible to reduce a size of the head unit 4 and a degree of freedom of a design of the head unit 4 is increased.

Figure 4:
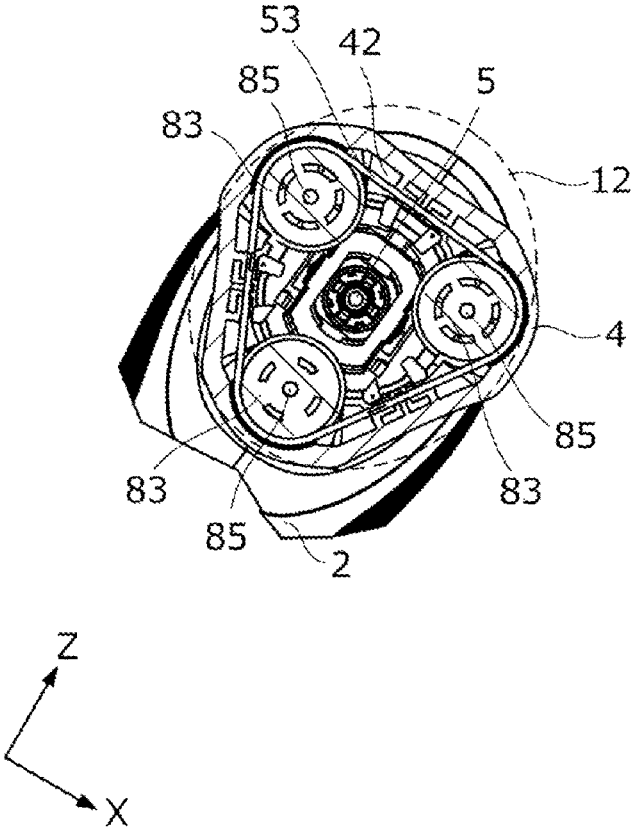
FIG. 4 is a sectional view that is taken along line Iv-Iv in FIG. 2 in which an internal structure is omitted and is a schematic view illustrating an example of a second transmission mechanism.
Figure 5:
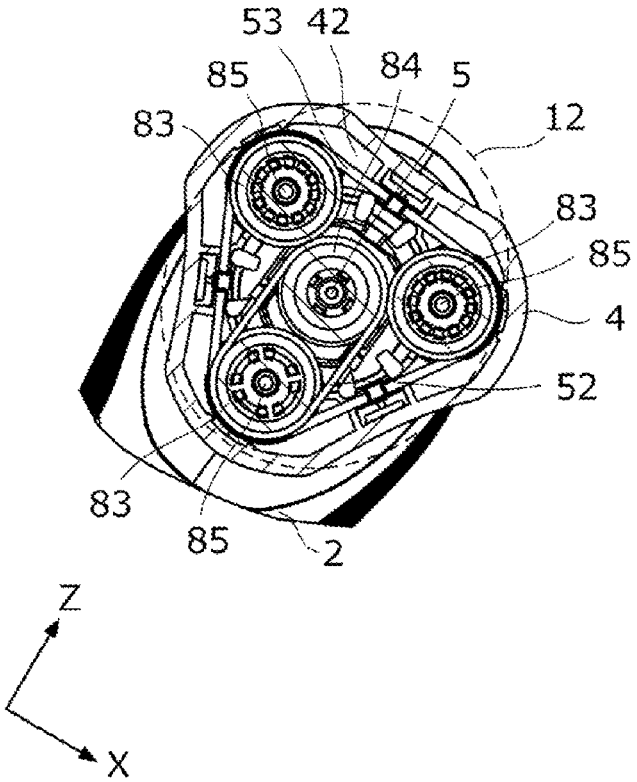
FIG. 5 is a sectional view that is taken along line v-v in FIG. 2 in which an internal structure is omitted and is a schematic view illustrating an example of the second transmission mechanism.

As illustrated in FIGS. 4 and 5, the second transmission mechanism 12 of the belt driving system for transmitting the driving power of the first transmission mechanism 11 via the drive shaft 5 to rotate the driven shaft 85 is built in the head unit 4.

The second transmission mechanism 12 is configured such that each of third pulleys 83 is connected to each of three driven shafts 85 and a fourth pulley 84 is connected to the drive shaft 5 on the head unit 4 side. A second endless belt 52 is wound around one or more of the third pulleys 83 and the fourth pulley 84. In the example illustrated in FIG. 5, the second endless belt 52 is wound around one of the third pulleys 83 and the fourth pulley 84. As illustrated in FIG. 4 and the like, a third endless belt 53 is disposed in the second transmission mechanism 12 and the third endless belt 53 is wound around all of the third pulleys 83.

According to the configuration, since the second endless belt 52 is wound around two pulleys including one of the third pulleys 83 and the fourth pulley 84, it is possible to apply tension evenly for the belt, therefore eliminating the need for tension adjustment, so that it is possible to maintain a current size. In addition, in a state where three third pulleys 83 surround the fourth pulley 84 and are disposed at equal intervals in the circumferential direction, it is possible to apply tension evenly for the belt by winding the third endless belt 53, therefore eliminating the need for tension adjustment, so that it is possible to maintain a current size. The "gear sound" can be eliminated by using the belt driving system, so that noise-reduction is performed.

For example, the second endless belt 52 and the third endless belt 53 are one-side toothed belts and the third pulley 83 and the fourth pulley 84 are toothed pulleys. Therefore, slip is prevented. Moreover, it is not limited to the example and both the second endless belt 52 and the third endless belt 53 may be flat belts or V-belts.

For example, a diameter of the fourth pulley 84 is set to be 0.5 times or more and less than 1.5 times of the third pulley 83. Preferably, a diameter of the fourth pulley 84 is set to be substantially 1 time of the third pulley 83. As a result, it is possible to reduce the size of the head unit 4 and the degree of freedom for design of the head unit 4 is increased.

According to the embodiment, since each of the first transmission mechanism 11 and the second transmission mechanism 12 is driven by an endless belt, it is possible to apply tension evenly for each belt and each of the transmission mechanisms, therefore eliminating the need for tension adjustment, so that it is possible to maintain a current size. The "gear sound" can be eliminated by using the belt driving system, so that noise-reduction is performed.

In the embodiment, synthetic rubber, polyurethane, and other known synthetic resins are used for the first endless belt 51, the second endless belt 52, and the third endless belt 53. These synthetic resin belts may embed core wires of glass fibers or aramid fibers in an inside, and thereby it is possible to obtain a high strength by pressing the extension. For example, a drip-proof performance and a waterproof performance can be improved in addition to a silent performance by applying waterproof synthetic resin to the first endless belt 51, the second endless belt 52, and the third endless belt 53.

In the embodiment, polyacetal, polycarbonate, other known synthetic resin materials, or metal materials such as iron steel and aluminum is applied to the first pulley 71, the second pulley 72, the third pulley 83, and the fourth pulley 84. For example, a drip-proof performance and a waterproof performance can be improved in addition to a silent performance by applying waterproof synthetic resin to the first pulley 71, the second pulley 72, the third pulley 83, and the fourth pulley 84.

Line P1-P1 passes through the center of the connecting portion 3 in an axial direction, the center of the drive shaft 5, and the outer blade 81 of the head unit 4 in FIG. 2 is in a position parallel to the output shaft 75 of the motor 7. According to the configuration, a transmission loss of the belt drive can be minimized.

Figure 6:
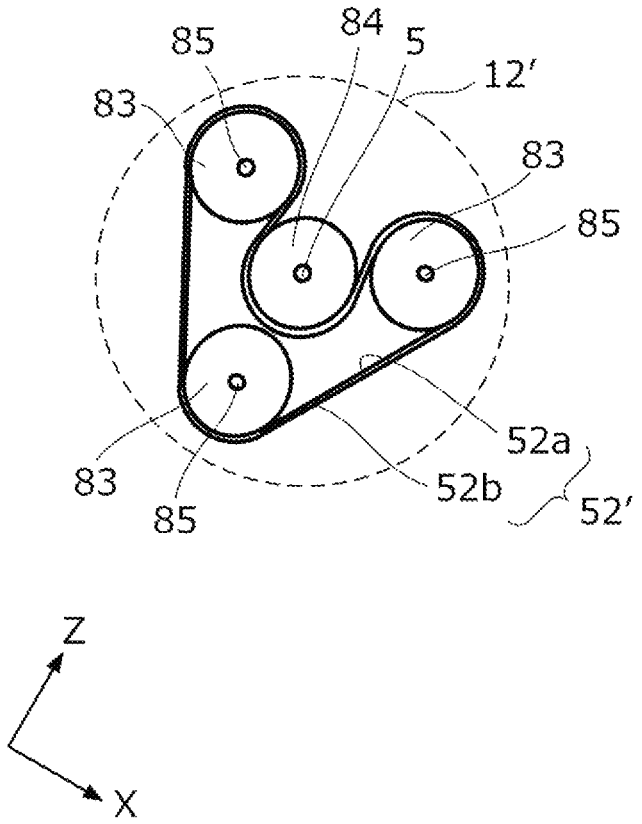
FIG. 6 is a schematic view illustrating another example of the second transmission mechanism of the rotary electric shaver according to the embodiment.

FIG. 6 is a schematic view illustrating another example of the second transmission mechanism 12' of the electric shaver 1 according to the embodiment. In the example illustrated in FIGS. 4 and 5, a configuration, in which two belts of a second endless belt 52' and the third endless belt 53 are used, is described, but as illustrated in FIG. 6, only the second endless belt 52' may be used.

In the example illustrated in FIG. 6, the second endless belt 52' is a double-face toothed belt, a first surface 52*a* of the second endless belt 52' is wound around all of the third pulleys 83, and a second surface 52*b* on a side opposite to the first surface 52*a* is wound around the fourth pulley 84. According to the configuration, in a state where three third pulleys 83 surround the fourth pulley 84 and are disposed at equal intervals in the circumferential direction, it is possible to apply tension evenly for the belt by winding the second endless belt 52', therefore, eliminating the need for tension adjustment, so that it is possible to maintain a current size. The "gear sound" can be eliminated by using the belt driving system, so that noise-reduction is performed. Furthermore, it is possible to reduce the number of components and also to save space.

The invention is not limited to the above-described embodiment, and various modifications are possible without departing from the invention.

For example, in the above-described embodiment, a configuration, in which the three blade units 8 are disposed, is described, but the invention is not limited to the embodiment. There are cases where two blade units 8 are disposed or four or more blade units 8 are disposed.

What is claimed is:

1. A rotary electric shaver comprising:

a main body in which a motor, which generates a drive force, and a first transmission mechanism are disposed;

a head unit in which a plurality of blade units each having an outer blade having a circular shaving surface on an outer side, an inner blade being in sliding contact with an inner surface of the outer blade, and a driven shaft rotating the inner blade are disposed, and in which a second transmission mechanism is disposed; and a connecting portion that intervenes between and is connected to the main body and the head unit wherein the connecting portion includes a drive shaft having two end portions including a first end portion and a second end portion, the first end portion of which projects to and is coupled to the main body and the second end portion of which projects to and is coupled to the head unit, and a coupling portion of the drive shaft, which is a middle section sandwiched between the two end portions, is disposed in the connecting portion and capable of a swing movement such that the head unit swings with respect to the main body, wherein the first transmission mechanism includes a first endless belt and the second transmission mechanism includes a second endless belt and a third endless belt;

the first transmission mechanism is configured such that a first pulley is connected to an output shaft of the motor, a second pulley is connected to the first end portion of the drive shaft on a side of the main body, and the first endless belt is wound around the first pulley and the second pulley, conveying the drive force to the drive shaft through the first endless belt; and the second transmission mechanism is configured such that each of the blade units has a third pulley, and the third pulley is connected to the driven shaft, which is disposed in the blade unit, a fourth pulley is connected to the second end portion of the drive shaft on a side of the head unit, the second endless belt is wound around at least one of the third pulleys, which is defined as a designated third pulley, and the fourth pulley, conveying the drive force to the designated third pulley through the second endless belt;

the third endless belt is wound around the designated third pulley and all of the remaining third pulleys, which are other than the designated third pulley, conveying the drive force to the inner blades connected to the driven shafts through the third endless belt, the second endless belt and the third endless belt are both toothed belts, a diameter of the second pulley is set to be 2 times or more and less than 4 times a diameter of the first pulley; and a diameter of the fourth pulley is set to be 0.5 times or more and less than 1.5 times a diameter of the designated third pulley.

2. The rotary electric shaver according to claim 1, wherein the second endless belt is a double-face toothed belt including a first surface and a second surface, wherein the first surface of the second endless belt is wound around all of the third pulleys and the second surface on a side opposite to the first surface is wound around the fourth pulley.

3. The rotary shaver according to claim 2, wherein the head unit further includes an outer blade frame that holds the blade units such that each of the blade units are capable of a blade unit swing movement, and a blade setting base through which the driven shaft penetrates, and which holds the outer blade frame; and wherein the blade units are disposed at equal intervals in a circumferential direction with respect to a center of the head unit in a plan view.

4. The rotary electric shaver according to claim 1, wherein the head unit further includes an outer blade frame that holds the blade units such that each of the blade units are capable of a blade unit swing movement, and a blade setting base through which the driven shaft penetrates, and which holds the outer blade frame; and wherein the blade units are disposed at equal intervals in a circumferential direction with respect to a center of the head unit in a plan view.

* * * * *